US007876293B2

(12) United States Patent
Liu

(10) Patent No.: US 7,876,293 B2
(45) Date of Patent: Jan. 25, 2011

(54) IMAGE DISPLAY SYSTEM

(75) Inventor: Ping-Lin Liu, Hsinchu (TW)

(73) Assignee: TPO Displays Corp., Chu-Nan (TW)

( * ) Notice: Subject to any disclaimer, the term of this patent is extended or adjusted under 35 U.S.C. 154(b) by 827 days.

(21) Appl. No.: 11/894,191

(22) Filed: Aug. 20, 2007

(65) Prior Publication Data

US 2008/0048947 A1 Feb. 28, 2008

(30) Foreign Application Priority Data

Aug. 24, 2006 (TW) ..... 95131085 A

(51) Int. Cl.
*G09G 3/30* (2006.01)

(52) U.S. Cl. ..... 345/76; 345/205; 345/690; 315/169.3; 315/299; 327/387; 327/390

(58) Field of Classification Search ..... 345/76–80, 345/205, 206, 211–214, 690; 315/161–164, 315/169.3, 170, 195–199, 299; 327/387, 327/389, 390, 391
See application file for complete search history.

(56) References Cited

U.S. PATENT DOCUMENTS 6,724,376 B2 * 4/2004 Sakura et al. ..... 345/204
7,414,599 B2 * 8/2008 Chung et al. ..... 345/76
7,724,231 B2 * 5/2010 Nakao et al. ..... 345/98

* cited by examiner

*Primary Examiner*—Henry N Tran
(74) *Attorney, Agent, or Firm*—Liu & Liu

(57) ABSTRACT

An image display system comprises a pixel driving circuit. A storage capacitor is coupled between the first and second nodes. The first switch is turned on in the first and second periods. The second switch, coupled to the first node, is turned on in the first and second periods. The third switch, coupled between the second node and the first switch, is turned on in the first, third and fourth periods. The fourth switch, coupled between the second switch and the first voltage, is turned on in the first, third and fourth periods. The fifth switch, coupled between the second node and the first voltage, is turned on in the first, second and third periods. The sixth switch, coupled between the first node and the reference voltage, is turned on in the fourth period. The first transistor is coupled between the first and second switches and is turned on in the fourth period. During the second period, the voltage between source and gate of the first transistor is a threshold voltage. The electroluminescent element emits light in the fourth period.

20 Claims, 2 Drawing Sheets

IMAGE DISPLAY SYSTEM

BACKGROUND OF THE INVENTION

1. Field of the Invention

The invention relates to a pixel driving circuit, and in particular to a pixel driving circuit with threshold voltage and power supply voltage compensation.

2. Description of the Related Art

Organic light emitting diode (OLED) displays utilizing organic compounds as a lighting material are common in flat displays, providing desired small size, light weight, wider viewing angle, high contrast ratio and high response speed.

Active matrix organic light emitting diode (AMOLED) displays are currently emerging as the next generation of flat panel displays. Compared with active matrix liquid crystal displays (AMLCD), the AMOLED display has many advantages, such as high contrast ratio, wide viewing angle, thin module without backlight, low power consumption, and low cost. Unlike the AMLCD display, which is driven by a voltage source, an AMOLED display requires a current source to drive an electroluminescent element. The brightness of the electroluminescent element is proportional to the current conducted thereby. Variations in current level have a great impact on brightness uniformity of an AMOLED display. Thus, the quality of a pixel driving circuit is critical to the quality of an AMOLED display.

FIG. 1 shows a conventional 2T1C (2 transistors and 1 capacitor) pixel driving circuit 10 in an AMOLED display. Pixel driving circuit 10 comprises transistors Mx and My, electroluminescent element EL and capacitor Cst. When signal Scan turns on transistor Mx, data signal shown as $V_{data}$ in the FIG. 1 is loaded into a gate of p-type transistor My and stored in capacitor Cst, providing a constant current driving electroluminescent element EL to emit light. Typically, in an AMOLED display, a current source is implemented by a P-type Thin film transistor (TFT) (My in FIG. 1) gated by data signal $V_{data}$ and having source and drain connected to $V_{dd}$ and the anode of electroluminescent element EL, respectively, as shown in FIG. 1. The brightness of electroluminescent element EL with respect to $V_{data}$ therefore has the following relation.

$$\text{Brightness} \propto \text{current} \propto (V_{dd}-V_{data}-V_{th})^2$$

Where Vth is a threshold voltage of transistor My and $V_{dd}$ is a power supply voltage.

Since there is typically a variation in Vth for a LTPS type TFT due to a low temperature polysilicon (LTPS) process, non-uniform brightness can occur in an AMOLED display if threshold voltage Vth is not properly compensated. Moreover, a voltage drop in the power line also causes the brightness non-uniformity problem. To overcome such problems, implementation of a pixel driving circuit with threshold voltage Vth and power supply voltage $V_{dd}$ compensation to improve display uniformity is required.

BRIEF SUMMARY OF THE INVENTION

A detailed description is given in the following embodiments with reference to the accompanying drawings.

The invention provides an image display system comprising a pixel driving circuit. The pixel driving circuit comprises a storage capacitor coupled between a first node and a second node, a first switch receiving a first signal and turned on in a first period and a second period, a second switch coupled to the first node and turned on in the first period and the second period, a third switch coupled between the second node and the first switch and turned on in the first period, a third period and a fourth period, a fourth switch coupled between the second switch and a first voltage and turned on in the first period, the third period and the fourth period, a fifth switch coupled between the second node and the first voltage and turned on in the first period, the second period and the third period, a sixth switch coupled between the first node and a reference voltage and turned on in the fourth period, a first transistor having a gate coupled to the first switch, a source coupled to the second switch and a drain and turned on in the fourth period, wherein the voltage between the source and the gate of the first transistor is a threshold voltage in the second period and a electroluminescent element coupled between the drain of the first transistor and a second voltage and emitting light in the fourth period.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
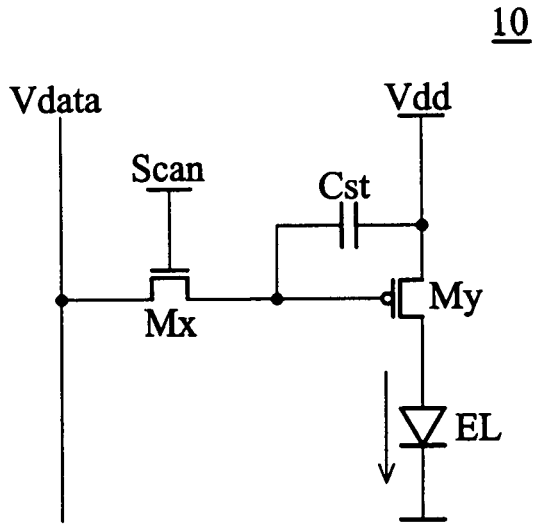
FIG. 1 (PRIOR ART)
FIG. 1 shows a conventional 2T1C pixel driving circuit in an AMOLED display.
Figure 2:
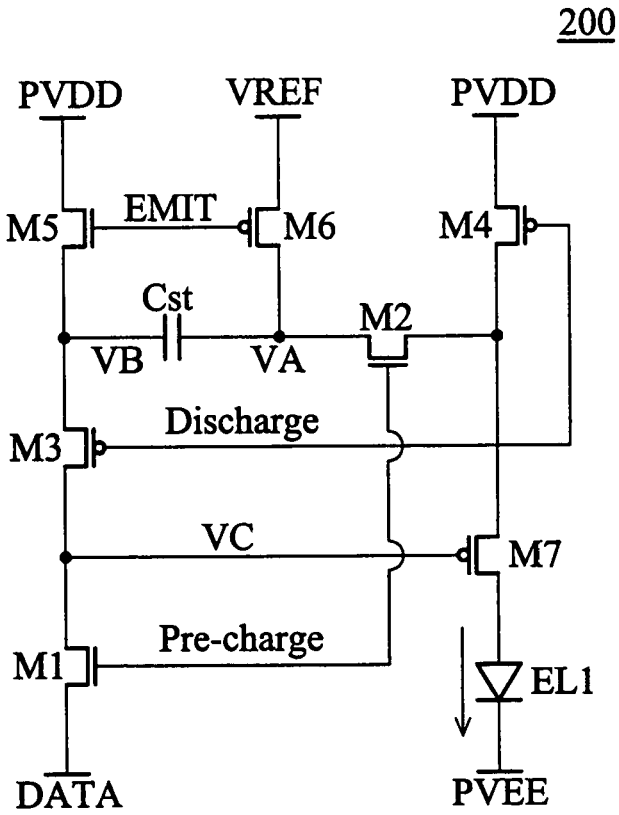
FIG. 2 shows a pixel driving circuit according to an embodiment of the invention.

FIG. 2 shows pixel driving circuit 200 according to an embodiment of the invention, compensating threshold voltage Vth and first voltage PVDD, and comprising storage capacitor Cst, first transistor M1, second transistor M2, third transistor M3, fourth transistor M4, fifth transistor M5, sixth transistor M6, seventh transistor M7 and electroluminescent element EL1. Storage capacitor Cst is coupled between fifth transistor M5 and sixth transistor M6 and also between first node VA and second node VB. First transistor M1 has a gate receiving precharge signal Pre-charge, a drain coupled to third transistor M3 and a source receiving data signal DATA. Second transistor M2 has a gate receiving precharge signal Pre-charge and is coupled between first node VA and fourth transistor M4. Third transistor M3 has a gate receiving discharge signal Discharge and is coupled between fifth transistor M5 and first transistor M1. Fourth transistor M4 has a gate receiving discharge signal Discharge and a source coupled to first voltage PVDD and a drain coupled to second transistor M2. Fifth transistor M5 has a gate receiving lighting signal EMIT and is coupled between first voltage PVDD and second node VB. Sixth transistor M6 has a gate receiving lighting signal EMIT and is coupled between reference voltage VREF and first node VA. Seventh transistor M7 (driving transistor) has a gate coupled to the drain of first transistor M1, a source coupled to second transistor M2 and a drain coupled to electroluminescent element EL1. Electroluminescent element EL1 is coupled between the drain of seventh transistor M7 and second voltage PVEE. First transistor M1, second transistor M2 and fifth transistor M5 are NMOS (Negative-Channel Metal Oxide Semiconductor) transistors, and third transistor M3, fourth transistor M4, sixth transistor M6 and seventh transistor M7 are PMOS (Positive-Channel Metal Oxide Semiconductor) transistors. In addition, performance of second transistor M2 improves with reduced size thereof Length-width ratio of the gate of fifth transistor M5 is proportional to the length-width ratio of the gate of seventh transistor M7.

Figure 3:
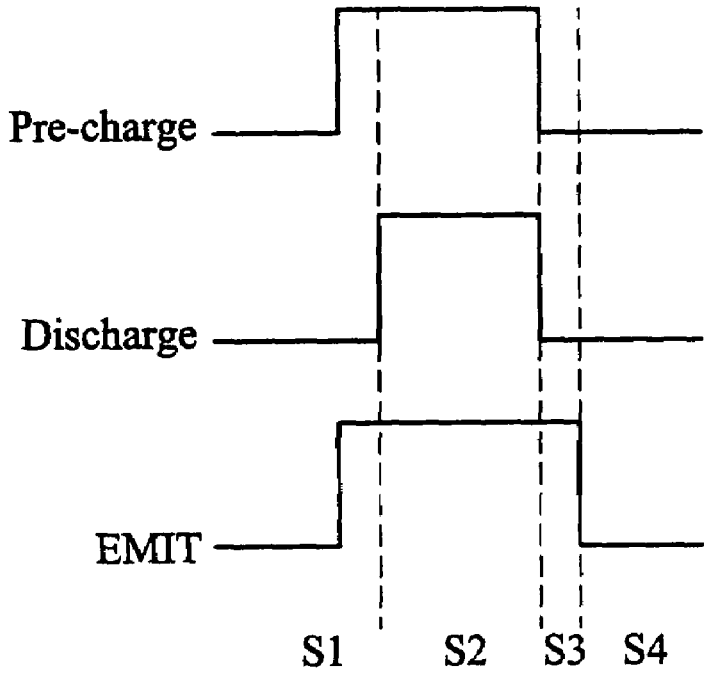
FIG. 3 shows a timing diagram of precharge signal, discharge signal and lighting signal of pixel driving circuit according to an embodiment of the invention.

FIG. 3 shows a timing diagram of precharge signal Pre-charge, discharge signal Discharge and lighting signal EMIT of pixel driving circuit 200 according to an embodiment of the invention. Precharge signal Pre-charge is high logic level in precharge period S1 and discharge period S2 and is low logic level in connection period S3 and emission period S4. Discharge signal Discharge is high logic level in discharge period S2 and is low logic level in precharge period S1, connection period S3 and emission period S4. Lighting signal EMIT is high logic level in precharge period S1, discharge period S2 and connection period S3 and is low logic level in emission period S4.

In precharge period S1 (first period), precharge signal Pre-charge and lighting signal EMIT are high logic level and discharge signal Discharge is low logic level. Thus, first transistor M1, second transistor M2, third transistor M3, fourth transistor M4 and fifth transistor M5 are turned on and sixth transistor M6 is turned off. At this time, the voltage level of first node VA and second node VB of storage capacitor Cst is equal to the voltage level of first voltage PVDD and the voltage level of third node VC is also equal to the voltage level of first voltage PVDD. In addition, seventh transistor M7 is turned off as voltage levels of the gate and the source of seventh transistor M7 equal first voltage PVDD.

In discharge period S2 (second period), precharge signal Pre-charge, discharge signal Discharge and lighting signal EMIT are high logic level. Thus, first transistor M1, second transistor M2 and fifth transistor M5 are turned on and third transistor M3, fourth transistor M4 and sixth transistor M6 are turned off. The voltage level of third node VC is equal to the voltage level of data signal DATA and the voltage level of second node VB is equal to the voltage level of first voltage PVDD. Since the voltage level of third node VC is equal to the voltage level of data signal DATA and second transistor M2 is turned on, the voltage level of first node VA is DATA+Vth (Vth is the threshold voltage of seventh transistor M7). At this time, the cross voltage between first node VA and second node VB of storage capacitor Cst is DATA+Vth−PVDD.

In connection period S3 (third period), lighting signal EMIT is high logic level and precharge signal Pre-charge and discharge signal Discharge are low logic level. Thus, third transistor M3, fourth transistor M4 and fifth transistor M5 are turned on, and first transistor M1, second transistor M2 and sixth transistor M6 are turned off. Thus, the voltage level of first node VA is DATA+Vth and the voltage level of second node VB and third node VC are the voltage level of first voltage PVDD. Since voltage levels of the gate and the source of seventh transistor M7 equal first voltage PVDD, seventh transistor M7 is turned off.

In emission period S4 (fourth period), precharge signal Pre-charge, discharge signal Discharge and lighting signal EMIT are all low logic level. Thus, third transistor M3, fourth transistor M4, and sixth transistor M6 are turned on, and first transistor M1, second transistor M2 and fifth transistor M5 are turned off. The voltage level of first node VA is the voltage level of reference voltage VREF. Due to the voltage drop between node VA and node VB of storage capacitor Cst unable to change immediately, the voltage level of second node VB is PVDD−(DATA+Vth−VREF). Current through electroluminescent element EL1 being proportional to $(Vsg-Vth)^2$ and to $(PVDD-VB-Vth)^2=(DATA-VREF)^2$, and the brightness of electroluminescent element EL1 being proportional to the current conducted thereby dictates that brightness of electroluminescent element EL1 has no relation to threshold voltage Vth of seventh transistor M7 and first voltage PVDD. In emission period S4, first voltage PVDD is provided only to fourth transistor M4, seventh transistor M7 and electroluminescent element EL1 and no other. Thus, electroluminescent element EL1 is not affected by other signals in emission period S4. In addition, first transistor M1, second transistor M2, third transistor M3, fourth transistor M4, fifth transistor M5, sixth transistor M6 and seventh transistor M7 may be polysilicon thin film transistors for providing high current. First voltage PVDD is a power supply voltage and between 7 and 10V and data signal DATA is between 0.5 and 4V. In addition, if the timing of each transistor M1, M2, M3, M4, M5 and M6 turned on is the same as that described, first transistor M1, second transistor M2 and fifth transistor M5 may be PMOS and third transistor M3, fourth transistor M4, and sixth transistor M6 may be NMOS. It is noted that first period S1, second period S2, third period S3 and fourth period S4 occur in order.

Figure 4:
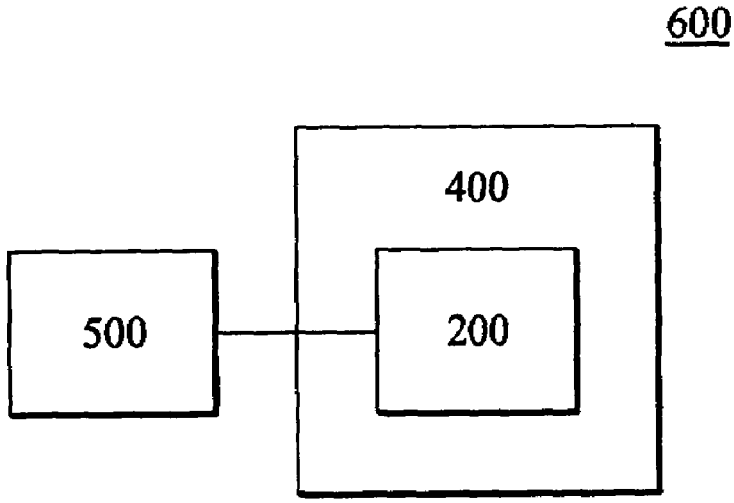
FIG. 4 schematically shows another embodiment of a system for displaying images.

FIG. 4 schematically shows another embodiment of a system for displaying images which, in this case, is implemented as display panel 400 or electronic device 600. As shown in FIG. 4, display panel 400 comprises pixel driving circuit 200 of FIG. 2. Display panel 400 can form a portion of a variety of electronic devices (in this case, electronic device 600). Generally, electronic device 600 can comprise display panel 400 and input unit 500. Further, input unit 500 is operatively coupled to display device 400 and provides input signals (e.g., an image signal) to display device 400 to generate images. Electronic device 600 can be a mobile phone, digital camera, PDA (personal digital assistant), notebook computer, desktop computer, television, car display, or portable DVD player, for example.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An image display system, comprising:

a pixel driving circuit, comprising:

a storage capacitor coupled between a first node and a second node;

a first switch receiving a first signal and turned on in a first period and a second period;

a second switch coupled to the first node and turned on in the first period and the second period;

a third switch coupled between the second node and the first switch and turned on in the first period, a third period and a fourth period;

a fourth switch coupled between the second switch and a first voltage and turned on in the first period, the third period and the fourth period;

a fifth switch coupled between the second node and the first voltage and turned on in the first period, the second period and the third period;

a sixth switch coupled between the first node and a reference voltage and turned on in the fourth period;

a seventh switch comprising a transistor having a gate coupled to the first switch, a source coupled to the second switch and a drain and turned on in the fourth period, wherein the voltage between the source and the gate of the transistor is a threshold voltage in the second period; and an electroluminescent element coupled between the drain of the transistor and a second voltage and emitting light in the fourth period.

2. The image display system as claimed in claim 1, wherein the first switch and the second switch are controlled by a first control signal.

3. The image display system as claimed in claim 2, wherein the third switch and the fourth switch are controlled by a second control signal.

4. The image display system as claimed in claim 3, wherein the fifth switch and the sixth switch are controlled by a third control signal.

5. The image display system as claimed in claim 1, wherein the first switch, the second switch, the third switch, the fourth switch, the fifth switch and the sixth switch are metal oxide semiconductor transistors.

6. The image display system as claimed in claim 5, wherein the transistor is a positive-channel metal oxide semiconductor transistor.

7. The image display system as claimed in claim 6, wherein the first switch, the second switch and the fifth switch are negative-channel metal oxide semiconductor transistors and the third switch, the fourth switch and the sixth switch are positive-channel metal oxide semiconductor transistors.

8. The image display system as claimed in claim 7, wherein the first control signal is high logic level in the first period and the second period.

9. The image display system as claimed in claim 7, wherein the second control signal is high logic level in the second period.

10. The image display system as claimed in claim 7, wherein the third control signal is high logic level in the first period, the second period and the third period.

11. The image display system as claimed in claim 1, wherein the first node and the second node of the storage capacitor are charged to the first voltage in the first period.

12. The image display system as claimed in claim 1, wherein the voltage of the first node of the storage capacitor is sum of the first voltage and the threshold voltage in the second period and the third period.

13. The image display system as claimed in claim 1, wherein the first switch, the second switch, the third switch, the fourth switch, the fifth switch, the sixth switch and the transistor are polysilicon thin film transistors.

14. The image display system as claimed in claim 1, wherein the first period, the second period, the third period, and the fourth period occur in order.

15. The image display system as claimed in claim 1, wherein the first voltage is a power supply voltage.

16. The image display system as claimed in claim 1, wherein the first signal is between 0.5 and 4V.

17. The image display system as claimed in claim 1, wherein the first voltage is between 7 and 10V.

18. The image display system as claimed in claim 1, further comprising a display panel, wherein the pixel driving circuit forms a portion of the display panel.

19. The image display system as claimed in claim 18, further comprising an electronic device comprising:

the display panel; and an input unit coupled to the display device and operative to provide input to the display device such that the display device displays images.

20. The image display system as claimed in claim 19, wherein the electronic device is a mobile phone, digital camera, PDA, notebook computer, desktop computer, television, car display, or portable DVD player.

* * * * *